US008544447B2

(12) United States Patent
Heath et al.

(10) Patent No.: US 8,544,447 B2
(45) Date of Patent: Oct. 1, 2013

(54) THROTTLE RESPONSE MODIFICATION DEVICE AND METHOD FOR VEHICLES EQUIPPED WITH ELECTRONIC THROTTLE CONTROL

(75) Inventors: David E. Heath, Cypress, CA (US); Jorge A. Rodriguez, Los Angeles, CA (US)

(73) Assignee: V&H Performance, LLC, Santa Fe Springs, CA (US)

( * ) Notice: Subject to any disclaimer, the term of this patent is extended or adjusted under 35 U.S.C. 154(b) by 270 days.

(21) Appl. No.: 13/177,755

(22) Filed: Jul. 7, 2011

(65) Prior Publication Data

US 2012/0042851 A1 Feb. 23, 2012

Related U.S. Application Data

(60) Provisional application No. 61/402,054, filed on Aug. 23, 2010.

(51) Int. Cl.
*F02D 41/02* (2006.01)

(52) U.S. Cl.
USPC ..... 123/399; 123/361

(58) Field of Classification Search
USPC ..... 123/361, 399; 701/110; 73/114.25, 73/114.26, 114.36
See application file for complete search history.

(56) References Cited

U.S. PATENT DOCUMENTS

| | | | | |
|---|---|---|---|---|
| 5,983,861 | A * | 11/1999 | Nishio et al. | 123/399 |
| 6,499,461 | B2 * | 12/2002 | Kubota et al. | 123/361 |
| 7,017,550 | B2 * | 3/2006 | Hata et al. | 123/399 |
| 7,036,486 | B2 * | 5/2006 | Kamimura et al. | 123/399 |
| 7,171,946 | B1 * | 2/2007 | Watanabe | 123/399 |
| 7,240,665 | B2 * | 7/2007 | Hoshino et al. | 123/399 |
| 2009/0204301 | A1 | 8/2009 | Boulekos et al. | |

OTHER PUBLICATIONS

Blitz PowerUSA.com, "Throttle Controller Performance & ECO.," pp. 3, (2009). <http://www.blitzpowerusa.com/products/throcon/throcon.html.>.

* cited by examiner

*Primary Examiner* — Hai Huynh
(74) *Attorney, Agent, or Firm* — Dicke, Billig & Czaja, PLLC

(57) ABSTRACT

One aspect is an electronic throttle control system including an electronic control unit configured to receive actuation signals indicative of a user action and to generate an actuation signal indicative of the user action. A throttle plate motor is configured to receive the actuation signal from the electronic control unit and to move a throttle plate in response thereto. A throttle position sensor is configured to sense the actual position of the throttle plate and to generate an actual position signal indicative of the throttle plate position. A throttle modifier is coupled between the throttle position sensor and the electronic control unit and configured to modify the actual position signal into a modified position signal, and to send the modified position signal to the electronic control unit.

15 Claims, 4 Drawing Sheets

THROTTLE RESPONSE MODIFICATION DEVICE AND METHOD FOR VEHICLES EQUIPPED WITH ELECTRONIC THROTTLE CONTROL

CROSS REFERENCE TO RELATED APPLICATIONS

This Non-Provisional patent application claims the benefit of the filing dates of U.S. Provisional Patent Application Ser. No. 61/402,054, filed Aug. 23, 2010, entitled "THROTTLE RESPONSE MODIFICATION DEVICE FOR VEHICLES EQUIPPED WITH ELECTRONIC THROTTLE CONTROL" which is herein incorporated by reference.

BACKGROUND

One aspect relates to a device that plugs in between an electronic throttle body and the throttle body controller in order to provide an improved throttle response. In vehicles equipped with electronic throttle control, or throttle-by-wire, there are often issues with the responsiveness of the engine. In many cases, there is a factory-programmed electronic lag integrated in the system such that the engine does not immediately accelerate when the user actuates the pedal (in the case of a car or truck) or twist grip (in the case of a motorcycle). For these and other reasons, there is a need for the present invention.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principles of the invention. Other embodiments of the present invention and many of the intended advantages of the present invention will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
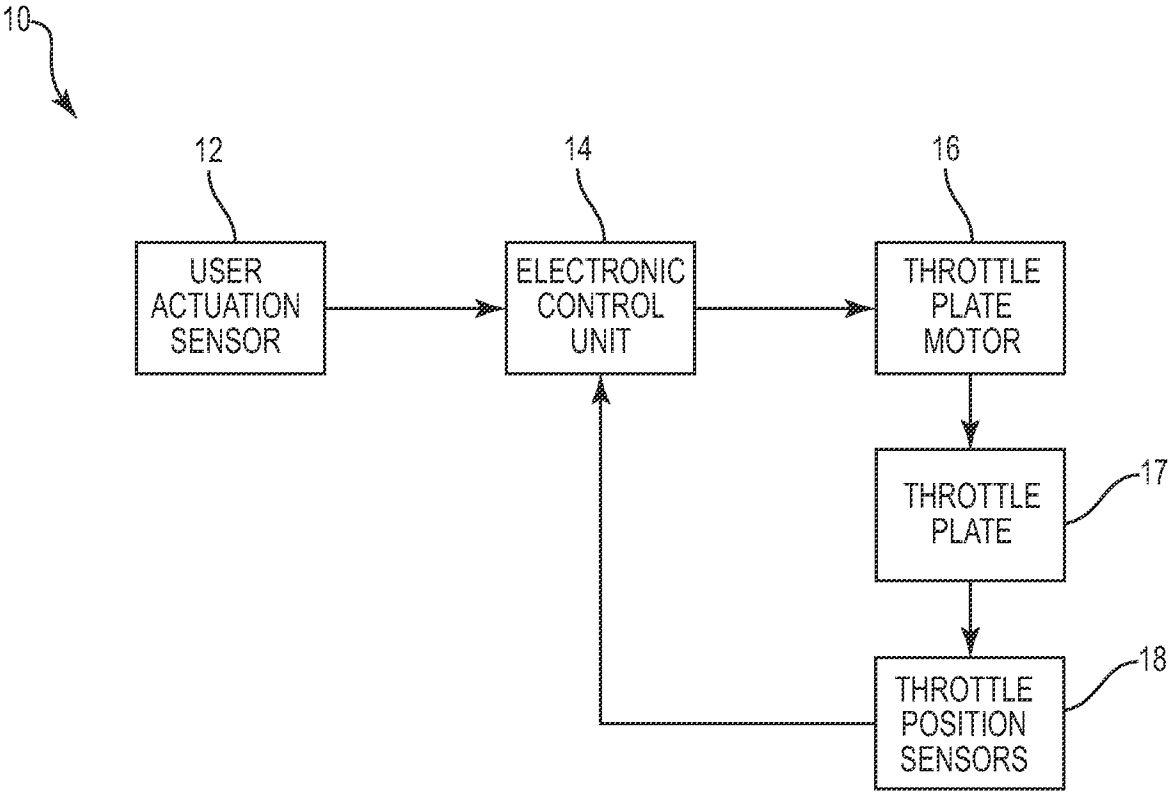
FIG. 1 illustrates a block diagram of an electronic throttle control system for a vehicle.

FIG. 1 illustrates electronic throttle control (ETC) system 10. ETC system 10 includes user actuation sensor 12, electronic control unit 14, throttle plate motor 16, throttle plate 17 and throttle position sensors 18. In many instances, ETC system 10 is used to facilitate signals between a user actuation sensor 12 and a throttle plate motor 16 and throttle plate 17 in a motor vehicle. ETC system 10 can be used in conjunction with a variety of motorized vehicles, such as cars, trucks, motor cycles and off-road vehicles.

In operation of ETC system 10, a user manipulates an accelerator pedal (such as on an automobile) or a twist grip (such as on an motorcycle) or the like, thereby producing a signal to actuation sensor 12. Actuation sensor 12 then produces an input signal to electronic control unit 14, which in turn controls throttle plate motor 16. Throttle plate motor 16 is coupled to and controls throttle plate 17 in the engine of the vehicle, such that signals from electronic control unit 14 sent to throttle plate motor 16 control acceleration in the vehicle by controlling the rotation of throttle plate 17.

For example, when a user has not yet pushed the accelerator petal or twisted the grip, throttle plate 17 is rotated substantially perpendicular to direction of airflow, such that it is in a "closed position" or "idle position." When a user has pushed the accelerator down or twisted the grip all the way to its maximum, throttle plate 17 is rotated substantially parallel to direction of airflow, such that it is in an "open position" or "wide-open throttle position." Throttle plate 17 can then be rotated to various positions between these two extremes responsive to the user's actuation.

Electronic control unit 14 sends the signals to throttle plate motor 16 to rotate plate 17, and then throttle position sensors 18 monitor throttle plate 17. Throttle position sensors 18 then provide a feedback signal to electronic control unit 14 as to the position of throttle plate 17 so that electronic control unit 14 is able to verify that plate 17 was moved to the correct position. If it is not, the position is adjusted. Once it is verified that plate 17 is in the correct position, electronic control unit 14 waits for actuation sensor 12 to send new signals representing further actuation from the user. In some examples, throttle position sensors 18 are connected to a shaft of throttle plate 17 in order to provide electronic control unit 14 with information on whether throttle plate 17 is in the idle position, the wide-open throttle position, or at some position in between these extremes.

Prior systems used a mechanical linkage between an accelerator pedal on an automobile, or twist grip on a motorcycle, and a throttle plate. ETC system 10 avoids such a mechanical linkage and relies instead on electronic signals that are processed and controlled in electronic control unit 14. ETC system 10 can take advantage of other on-board electronics to precisely control a vehicle's engine and ensure that the engine receives the correct amount of throttle plate opening for any given situation and ensure that harmful exhaust emissions are kept to a minimum.

In some situations, however, vehicles equipped with ETC system 10, can have a lack of responsiveness of the engine relative to the throttle actuation. In some cases, there is a factory-programmed electronic lag integrated in ETC system 10, such that the engine does not immediately accelerate when the user actuates the pedal (in the case of a car or truck) or twist grip (in the case of a motorcycle).

Figure 2:
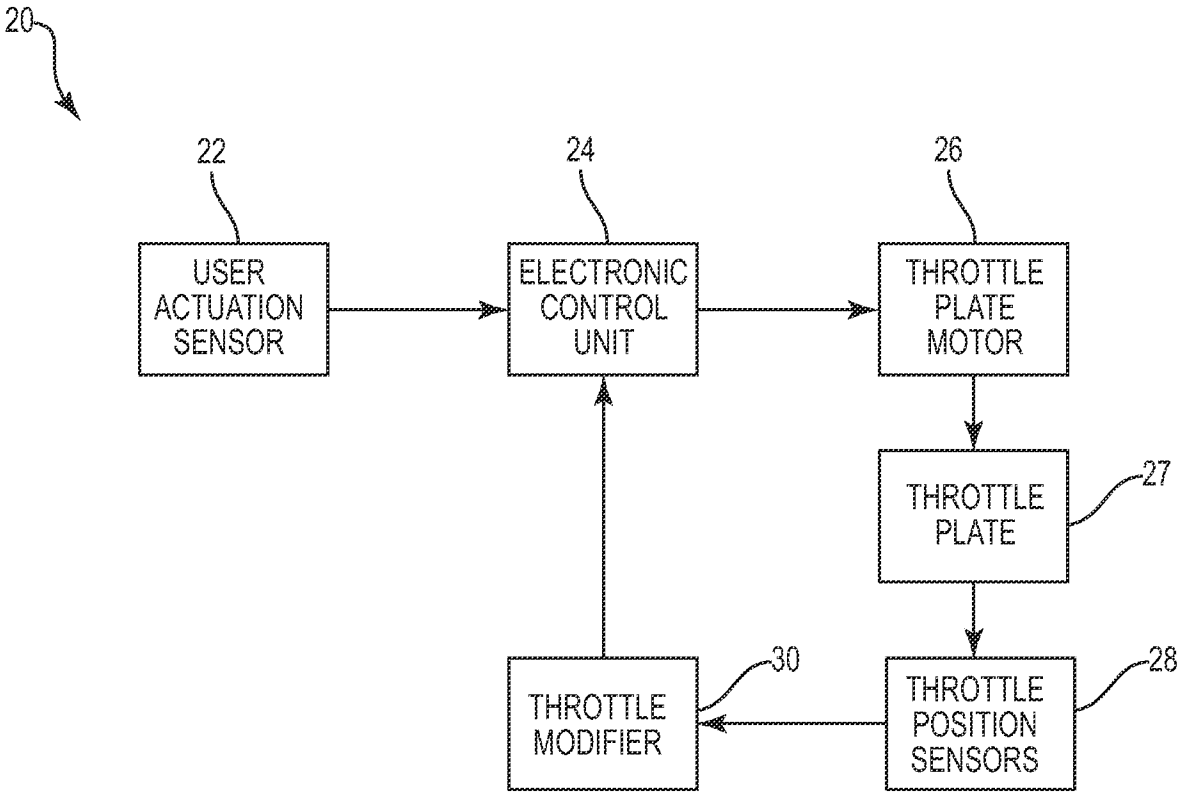
FIG. 2 illustrates a block diagram of an electronic throttle control system with a throttle modifier in accordance with one embodiment.

FIG. 2 illustrates electronic throttle control (ETC) system 20 in accordance with one embodiment. In one embodiment, (ETC) system 20 includes user actuation sensor 22, electronic control unit 24, throttle plate motor 26, throttle plate 27, throttle position sensors 28, and throttle modifier 30. In one embodiment, throttle modifier 30 receives throttle position signals, which are indicative of the actual position of throttle plate 27, from throttle position sensors 28, and it modifies the signals, such that the responsiveness of the engine relative to the user-initiated actuation is improved.

In one embodiment, throttle modifier 30 is coupled between electronic control unit 24 and throttle position sensors 28, which monitor the actual position of throttle plate 27, which is in turn controlled by throttle plate motor 26. In one embodiment, throttle modifier 30 calculates the average rate of change of the position of throttle plate 27 in order to calculate a normalized acceleration rate. In one embodiment, throttle modifier 30 calculates the average rate of change by monitoring the position of throttle plate 27 at specific time intervals. Rate of change is then calculated based on how the position of throttle plate 27 changes over those specific time intervals. A normalized acceleration rate is then calculated.

In one embodiment, throttle modifier 30 then multiplies the normalized acceleration rate by a scalar that is dependent on the position of throttle plate 27 in order to derive a new, scaled, normalized acceleration rate. This scaled, normalized acceleration rate is then passed through a transfer function, along with the actual position of plate 27, to obtain a modified position of plate 27. Throttle modifier 30 then passes this modified position of plate 27 to electronic control unit 24, rather than the actual position of plate 27 from throttle position sensors 28. In this way, the responsiveness of the engine relative to the user-initiated actuation is improved.

Figure 3:
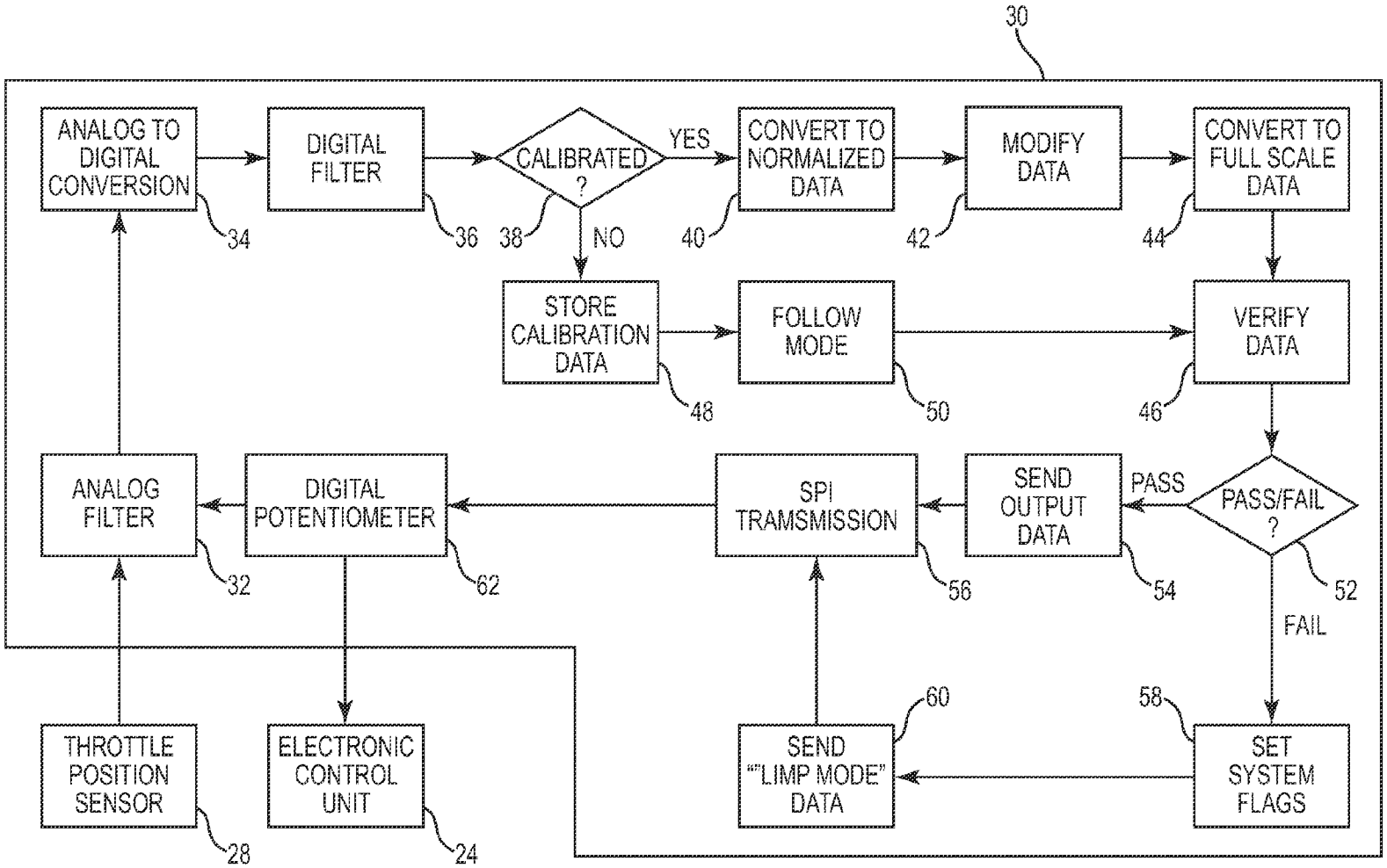
FIG. 3 illustrates a block diagram of a throttle modifier in accordance with one embodiment.

FIG. 3 illustrates a block diagram with further detail of throttle modifier 30 in accordance with one embodiment. As illustrated in FIG. 2, throttle modifier 30 receives actual throttle position signals from throttle position sensors 28. Throttle modifier 30 then calculates a rate of change from these signals taken over time, then uses this calculated rate of change to modify the actual throttle position signals, as will be discussed in more detail below, and then sends these modified position signals to electronic control unit 24.

In one embodiment, signals from throttle position sensors 28 are first received by analog filter 32 of throttle modifier 30. Signals are then converted from analog to digital at analog-to-digital converter 34. The digital signals are filtered at digital filter 36. Next, throttle modifier 30 checks on whether the throttle position signals have been calibrated at 38.

In one embodiment, throttle position signals are voltages that represent the actual position of throttle plate 17. For example, throttle position signals may vary between 0.17 and 4.33 volts. In one embodiment, the signals are "normalized" by calibrating the lower and upper signal values. In order to calibrate these end points, throttle modifier 30 assigns a "0" to the lower endpoint and a "1" to the higher. In this way, it is assured that throttle modifier 30 has accurate position information of throttle plate 17 before making any modification.

As such, if no calibration has yet occurred, throttle modifier 30 stores calibration data at 48, goes to a follow mode at 50 and then verify data at 46. In such an instance of no calibration, no data modification occurs. If calibration has occurred, then the position signals are converted to normalized data at 40. Next, this normalized data is modified at 42 by a transfer function that is dependent on the position of throttle plate 27. Data is then converted to full scale at 44 and then data is verified at 46.

After data verification, a pass-fail test of the data is employed at 52. If the data does not pass the applied test at 52, system flags are set at 58 and "limp mode" data is sent at 60. In this case, when limp mode data is transmitted to electronic control unit 24, this will signal electronic control unit 24 to essentially shut off or disable the throttle (causing the system to go "limp"), since the data values were not consistent with what was expected.

If the data does pass the applied test at 52, output data is sent at 54 to SPI transmission 56. SPI (or serial peripheral interface) transmission 56 communicates the output data to digital potentiometer 62. The output from digital potentiometer 62 is applied back to analog filter 32, for feeding back through throttle modifier 30, and sent to electronic control unit 24, for processing there.

As such, in operation, ETC system 20 with throttle modifier 30 provides an improved throttle response. Throttle position sensors 28 monitor the actual position values of throttle plate 27 in the throttle body and provides these values to throttle modifier 30. Throttle modifier 30 then calculates rate of change signals, and then creates modified position values, based on the actual position signals and the calculated rate of change signals, which are then communicated to electronic control unit 24. These modified position values cause the electronic control unit 24 to alter the position of throttle plate 27. This allows ETC system 20 to yield improved throttle response by opening throttle plate 27 further than it otherwise would.

Figure 4:
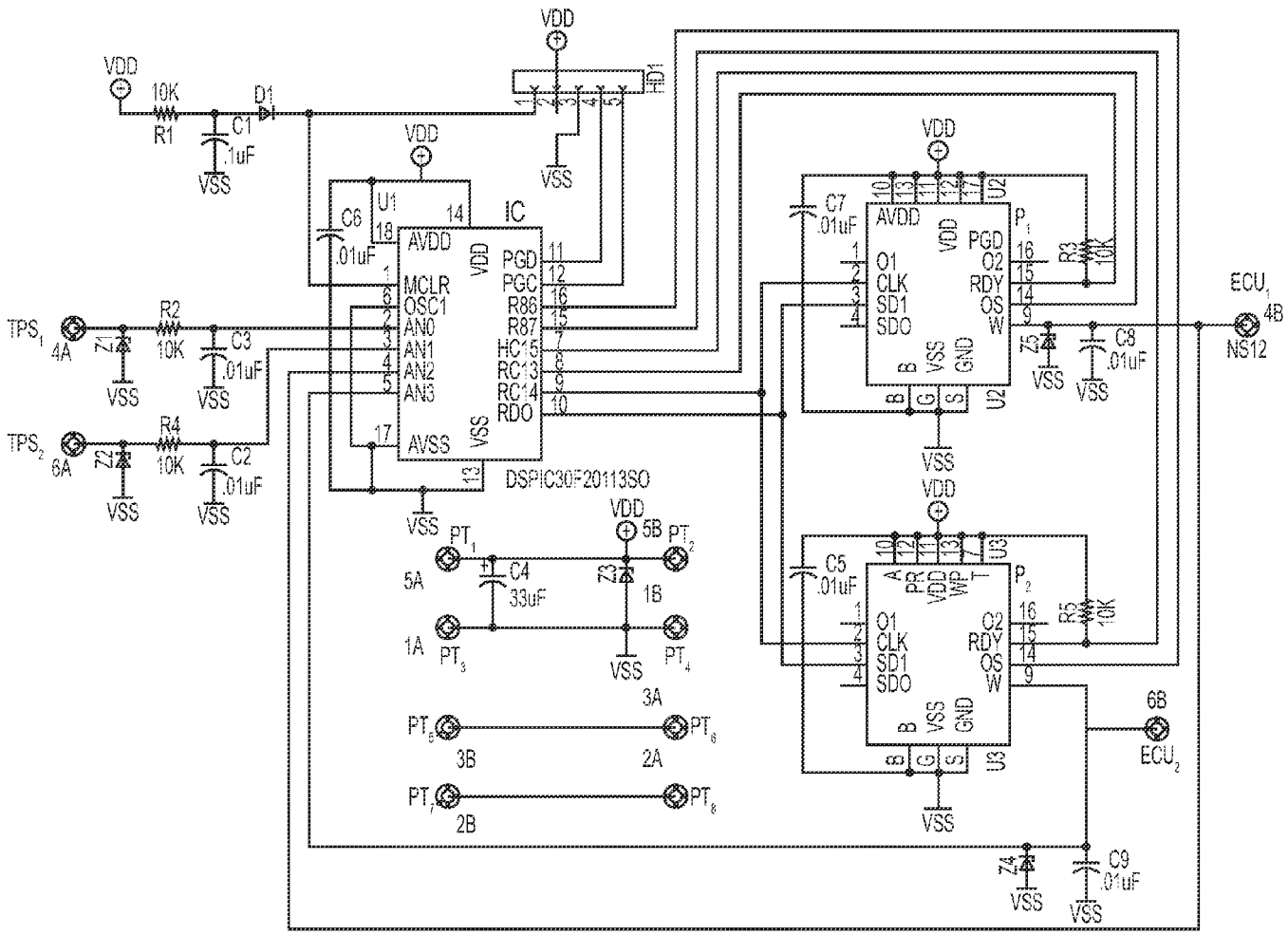
FIG. 4 illustrates a schematic diagram of a throttle modifier in accordance with one embodiment.

FIG. 4 illustrates an exemplary schematic for a throttle modifier 30 in accordance with one embodiment. In one embodiment, throttle position signals from throttle position sensors 28 are received by throttle modifier 30 as analog signals at terminals $S_1$ and $S_2$. These signals go through analog filters formed of the R-C components between terminals $S_1$ and $S_2$ and the integrated circuit chip IC. In one embodiment, integrated circuit chip IC is configured to perform the functions described above with respect to FIG. 3, from analog-to-digital conversion 34 through SPI transmission 56. Signals from integrated circuit chip IC then go to first and second potentiometers $P_1$ and $P_2$, and back to electronic control unit 24 via terminals $ECU_1$ and $ECU_2$.

In one embodiment, the schematic for a throttle modifier 30 further includes a plurality of pass-through terminals $PT_1$-$PT_8$. In one embodiment, throttle modifier 30 is a discrete component that can plug right into an ETC system 20 between electronic control unit 24 and throttle position sensors 28. In such case, it is often useful for throttle modifier 30 to include terminals that are able to pass signals between electronic control unit 24 and throttle position sensors 28, which are normally directly coupled when throttle modifier 30 is not coupled between them. As such, pass-through terminals $PT_1$-$PT_8$ are provided to pass signals right on through between electronic control unit 24 and throttle position sensors 28.

In one embodiment, the data modification (modify data 42 in FIG. 3 above) that occurs in throttle modifier 30 is a non-linear data modification. Using the throttle position signals from throttle position sensors 28, throttle modifier 30 is able to calculate the rate of change of the position of throttle plate 27. This calculated rate of change is related to the signal from actuation sensor 22, which is dependent on how fast a user twists a twist grip or pushes a pedal. Throttle modifier 30 also has the current position of throttle plate 27 that is associated with the calculated rate of change, from the position signals from throttle position sensors 28.

As such, throttle modifier 30 is able to multiply the current position signals from throttle position sensor 28 by a multiplier that is dependent on the desired position of throttle plate 27 and its first derivative (plate speed) and second derivative (plate acceleration) to obtain a new modified position. As such, the modified position is a non-linear function and is a dynamic modification.

In one embodiment, throttle modifier 30 interrupts the link between throttle position sensors 28 and electronic control unit 24 that exists in conventional systems, and in a sense, tricks electronic control unit 24. Instead of conveying to electronic control unit 24 that throttle plate 27 is in correct position, throttle modifier 30 conveys that it is almost there. Electronic control unit 24 responds by controlling throttle plate motor 26 to open plate 27 further. This continues ("open more") until the position of plate 27 (as modified by throttle modifier 30) is where electronic control unit 24 thinks it should be, or until the user changes the requested position via further actuation.

In one embodiment, a formula can be used to take a normalized throttle plate position, or a "normalized position signal," and to generate a modified normalized throttle plate position, or a "normalized modified position signal." In one example, the following formula is applied to a normalized position signal derived from throttle position sensors 28 in order to obtain the normalized modified position signals that is sent to the electronic control unit 24:

Second Stage $$y'_N = 0.5 + 0.5 * \sin\left(\pi\left(\underbrace{y'_{n-1} + \underbrace{\left(\frac{\overbrace{\left(\frac{1}{m} * \sum_{n=0}^{m-1}(y_n - y_{n-1})\right)}^{Ave\ ROC}}{y'_{max}}\right) - y'_{n-1}}_{Normalized\ Acceleration} * \underbrace{\left(0.001 + 0.009 * (1 - x_n^2)^2\right)}_{TPP\ Scalar}}_{First\ Stage}\right) - \frac{\pi}{2}\right)$$

$$\underbrace{y_{n+1} = x_n * \underbrace{(1 - \beta_{GAIN} * y'_n)}_{Dynamic\ Scalar}}_{Final\ Stage}$$

Where $y_n$ is the normalized and modified position signal at time n, n is any real integer number used to represent any given point in time, m is a real integer number used to establish data samples to be averaged (4 in one example), $y_{n-1}$ is the past normalized modified position at time n−1, $y'_{max}$ is the maximum rate of change used to normalize rate of change (25 in one example), $x_n$ is the normalized actual or current position signal, $y_{n+1}$ is the new normalized modified position at time n+1, and $\beta_{GAIN}$ is the gain of the normalized and modified position.

In one embodiment, the modified position that is sent to electronic control unit 24 and that is calculated in throttle modifier 30 is a non-linear function and is a dynamic modification. This has advantages over simply using a fixed amount of offset, such as controlling plate 27 open, for example, 5% more. With use of such a fixed and linear offset, electronic control unit 24 will learn how much it needs to adjust plate 27 to achieve the fixed offset. As such, the desired effect of improved responsiveness would only initially be achieved, but soon electronic control unit 24 would compensate for changes and no effect would be achieved.

Consequently, throttle modifier 30 calculates an amount of change that depends on the current plate position and first and second derivatives. This makes the effect dynamic and prevents electronic control unit 24 from learning the modification amount, and gives a smooth response when cruising, but "wakes up" when plate motion gets aggressive.

In one embodiment, for certain positions of throttle plate 27, throttle modifier 30 will not apply a modification to the position of throttle plate 27. For example, when throttle plate 27 is substantially perpendicular to direction of airflow, or in an idle position, throttle modifier 30 will not apply a modification to the position since a user is only beginning to move plate 27. At this position of throttle plate 27 there has been no significant user input, and accordingly, no significant movement. As such, there is no need for position modification in ETC system 20.

Once throttle plate 27 has substantially rotated away from perpendicular, or past idle position and toward open position, throttle modifier 30 will detect the position change of throttle plate 27 and apply a modification to the signals of throttle position sensors 28. Throttle modifier 30 then passes this modified position to electronic control unit 24. In this way, the responsiveness of the engine relative to the user-initiated actuation is improved.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An electronic throttle control system comprising:

an electronic control unit configured to receive actuation signals indicative of a user action and to generate an actuation signal indicative of the user action;

a throttle plate motor configured to receive the actuation signal from the electronic control unit and to move a throttle plate in response thereto;

a throttle position sensor configured to sense the actual position of the throttle plate and to generate an actual position signal indicative of the throttle plate position; and a throttle modifier coupled between the throttle position sensor and the electronic control unit and configured to modify the actual position signal into a modified position signal, and to send the modified position signal to the electronic control unit.

2. The electronic throttle control system of claim 1, wherein the throttle modifier monitors the position signals, calculates a rate of change of the throttle plate at specific time intervals, and modifies the position signal based on the calculated rate of change.

3. The electronic throttle control system of claim 2, wherein the calculated rate of change is passed through a transfer function in order to obtain a modified position signal, and wherein the modified position signal is passed back to the electronic control unit.

4. The electronic throttle control system of claim 1, wherein the electronic control unit generates an actuation signal that is based on the modified position signal for controlling the throttle plate motor.

5. The electronic throttle control system of claim 1, wherein the modification to the actual position signal is based on a nonlinear differential equation.

6. A method for electronically controlling a throttle comprising:

receiving actuation signals indicative of a user action and generating an actuation signal indicative of the user action;

causing a throttle plate motor to move a throttle plate in response to the actuation signal, the throttle plate controlled at least in part by an electronic control unit;

sensing the actual position of the throttle plate and generating an actual position signal indicative of the throttle plate position; and (a throttle position sensor)

modifying the actual position signal and sending the modified position signal to the electronic control unit.

7. The method of claim 6, wherein modifying the actual position signal further comprises monitoring the position signals, calculating a rate of change of the throttle plate at specific time intervals, and modifying the position signal based on the calculated rate of change.

8. The method of claim 7 further comprising passing the calculated rate of change through a transfer function in order to obtain a modified position signal, and further comprising passing the modified position signal back to the electronic control unit.

9. The method of claim 6 further comprising generating an actuation signal that is based on the modified position signal, the actuation signal controlling the throttle plate motor.

10. The method of claim 6, wherein the modification to the actual position signal is based on a nonlinear differential equation.

11. A motorized vehicle including an electronic throttle control system comprising:

an electronic control unit configured to receive actuation signals indicative of a user action and to generate an actuation signal indicative of the user action;

a throttle plate configured for rotation, the throttle plate rotation dependent on the actuation signal from the electronic control unit;

a throttle position sensor configured to sense the actual position of the throttle plate and to generate an actual position signal indicative of the throttle plate position; and a throttle modifier coupled between the throttle position sensor and the electronic control unit and configured to modify the actual position signal into a modified position signal, and to send the modified position signal to the electronic control unit.

12. The motorized vehicle of claim 11, wherein the throttle modifier monitors the position signals, calculates a rate of change of the throttle plate at specific time intervals, and modifies the position signal based on the calculated rate of change.

13. The motorized vehicle of claim 12, wherein the calculated rate of change is passed through a transfer function in order to obtain a modified position signal, and wherein the modified position signal is passed back to the electronic control unit.

14. The motorized vehicle of claim 11, wherein the electronic control unit generates an actuation signal that is based on the modified position signal for controlling the throttle plate motor.

15. The motorized vehicle of claim 11, wherein the modification to the actual position signal is based on a nonlinear differential equation.

* * * * *